US010391017B2

(12) United States Patent
Wanderman

(10) Patent No.: US 10,391,017 B2
(45) Date of Patent: Aug. 27, 2019

(54) ANGLE ADJUSTABLE CRUTCH HANDLE

(71) Applicant: First Freedom Financial, Inc., Grand Cayman (KY)

(72) Inventor: Steven Wanderman, Sedona, AZ (US)

(73) Assignee: First Freedom Financial, Inc, Grand Cayman (KY)

( * ) Notice: Subject to any disclaimer, the term of this patent is extended or adjusted under 35 U.S.C. 154(b) by 0 days.

(21) Appl. No.: 15/904,716

(22) Filed: Feb. 26, 2018

(65) Prior Publication Data

US 2019/0110944 A1 Apr. 18, 2019

Related U.S. Application Data

(63) Continuation-in-part of application No. 15/784,135, filed on Oct. 15, 2017, now Pat. No. 9,918,893.

(51) Int. Cl.
*A61H 3/02* (2006.01)

(52) U.S. Cl.
CPC ..... *A61H 3/02* (2013.01); *A61H 2201/0192* (2013.01)

(58) Field of Classification Search
CPC ..... A61H 3/00; A61H 3/02
USPC ..... 135/72
See application file for complete search history.

(56) References Cited

U.S. PATENT DOCUMENTS 904,481 A * 11/1908 Hood ..... A61H 3/02 135/69
1,077,216 A 10/1913 Bauerle
1,446,009 A 2/1923 Glowacki
2,197,279 A 9/1939 Thorssen
2,669,244 A 4/1952 Greene et al.
3,269,399 A 8/1966 Smith
3,517,678 A 6/1970 Gilsdorf
4,572,227 A 2/1986 Wheeler
4,625,743 A 12/1986 Harker
4,993,446 A 2/1991 Yarbrough
5,351,701 A 10/1994 Hsiao
5,381,813 A 1/1995 Miric et al.
5,791,360 A 8/1998 Battiston et al.
6,314,977 B1 11/2001 Obitts et al.
8,800,579 B2 8/2014 Severson et al.
9,320,671 B2 4/2016 Gelfand et al.
9,561,150 B2 2/2017 Dickerson, II
2003/0084932 A1* 5/2003 Kyungil-Cho ..... A61H 3/02 135/68

* cited by examiner

*Primary Examiner* — Noah Chandler Hawk

(74) *Attorney, Agent, or Firm* — Invention To Patent Services; Alex Hobson

(57) ABSTRACT

A crutch handle is positionably adjustable to crutch at an offset angle to provide an ergonomic position of a user's hand. The crutch handle has a curved adjustment adapter on both a first and second end of a handle-grip portion of the crutch handle. A fastener slot extends through the first and second adjustment adapters to allow a fastener to extend though and secure the handle to the crutch at an offset angle. The handle-grip has a fastener opening on at least one of the first or second ends to allow the fastener to be positioned along the handle-grip portion of the handle. A conventional crutch may be adapted with this angle adjustable crutch handle with the fasteners being in apertures that are aligned across the crutch support.

14 Claims, 10 Drawing Sheets

ANGLE ADJUSTABLE CRUTCH HANDLE

CROSS REFERENCE TO RELATED APPLICATIONS

This invention claims the benefit of priority to U.S. patent Ser. No. 15/784,135, filed on Oct. 15, 2017, entitled Angle Adjustable Crutch Handle and currently pending, the entirety of which is hereby incorporated by reference herein.

FIELD OF THE INVENTION

The invention relates to an angle adjustable crutch handle that is angle adjustable and secured between aligned grip apertures of a first and second crutch support.

BACKGROUND

Individuals requiring ambulatory aids, such as crutches ideally should support most of their weight on a hand support, such as the crutch handle. Conventional crutches are designed with a handle that is secured by a single fastener, such as a bolt, that extends through the crutch handle and through apertures in opposing, vertical crutch supports. The handle is therefore aligned with the crutch support apertures and is perpendicular to the vertical axis of the crutch. This places the hand in an abnormal, non-physiologic, radially deviated position causing abnormal, non-physiologic, compressive loads directed ulnaward across the radiocarpal joint of the involved upper extremity. The stresses of weight bearing transferred to the upper extremity via the use of crutches subjects the ligaments, nerves, joints and osseous structures of the wrist and surrounding structures to various overuse syndromes. The signs and symptoms of these overuse syndromes includes pain, swelling, muscle strain, tendonitis, synovitis, and neuropathies such as carpal tunnel syndrome to name a few.

The prevalence of wrist symptoms is frequently increased in the subset of patients requiring the prolonged use of crutches, those with pre-existing wrist pathology, and in the obese population. It is not uncommon to develop additional overuse-type symptoms as a result of a painful wrist incurred by the use of crutches in their current design. Once the wrist and surrounding structures become painful, there is a tendency to transfer weight bearing from the wrists to the shoulders via the use of the shoulder support of the crutch. The spectrum of additional complaints may include those associated with simple skin irritation of the shoulder to that secondary to impingement syndrome of the shoulder. Shoulder bursitis, tendonitis, synovitis and occasionally compromised integrity of the rotator cuff may occur simply due to overloading of the shoulder joint which was not designed as a weight bearing joint. Chronic compression of the axilla by the crutch shoulder support bar may cause direct injury to the nerves of the axilla of the shoulder resulting in a neuropraxia presenting as "crutch paralysis".

There is a need for a crutch grip that places the wrist in a comfortable, neutral position, by improving the length/tension relationship of the engaged muscles to allow for optimal performance and reduced potential for injury. Such a position would set the tone and foundation for better posture and alignment for those using crutches. Improved posture will not only decrease the potential for wrist pain but also for back and shoulder pain by keeping the whole upper extremity in proper alignment. Also, the improvement in posture will lead to improvements in confidence and efficiency in movement using the crutches.

SUMMARY OF THE INVENTION

The invention is directed to an angle adjustable crutch handle that enables a user to secure the crutch handle at an offset angle between aligned apertures of the crutch supports. Securing the crutch handle at an offset angle may provide for an ergonomic position of the user's hand and wrist for weight bearing. The handle-grip of the crutch handle may extend along the palmar crease, such as the along or between the distal palmar crease or proximal palmer crease. An exemplary angle adjustable crutch handle has a first and second adjustment adapter on opposing end of a handle-grip portion and, these adjustment adapters have a curved outer surface to allow engagement with the crutch supports while positioned at an offset angle. The adjustment adapters may be configured with a fastener slot to provide flexibility and a range of securing locations along the fastener slot. The handle-grip may be hollow or have an opening at an end to allow a fastener head to slide up into alignment with the handle-grip. In an exemplary embodiment, the handle-grip has a fastener opening of both ends. An exemplary crutch handle system may comprise an angle adjustable crutch handle having adjustment adapters on opposing ends and a crutch adapter for placement between the adjustment adapter and the crutch support. A crutch adapter may provide an interface with the crutch support to prevent the crutch handle from moving and/or rotating during use and may comprise a serrated mating surface with the adjustment adapter.

An exemplary crutch handle system may comprise an angle adjustable crutch handle having adjustment adapters on opposing ends of the handle-grip and crutch adapters that extend around the crutch support and engage with the adjustment adapters to secure them in position, or adapter brackets. An adapter bracket may have a serrated mating surface that engages with the outer surface of the adjustment adapter to hold it in an offset angular orientation. The adapter bracket extends around opposing sides of the crutch support to provide mating surfaces on either side of the adjustment adapter. This ensures that the handle-grip will not spin or rotate. An exemplary adapter brackets may also receive the fastener and a fastener retainer, such as a wing nut, may be used to hold the adapter bracket to the crutch support and to the adjustment adapter.

The handle-grip of the present invention provides for a neutral position of the hand and wrist. The adjustable handle-grip can maintain parallel orientation in the coronal plane of the longitudinal axis through the third metacarpal, capitate, lunate, and diaphysis of the radius thereby providing optimal transfer of compressive load bearing forces from the hand and proximally to the forearm.

The outer surface of the adjustment adapter is curved to allow engagement and securing of the crutch handle to the crutch supports at an offset angle. The outer surface may extend at a radius, such as a radius of about 5 cm or more, about 10 cm or more, about 15 cm or more and any range between and including the radius values provided.

An exemplary crutch handle may be made out of any suitable material that can withstand the weight and forces exerted thereon including, but not limited to, metal, plastic, wood, composites, and the like. In an exemplary embodiment, the handle-grip portion is a hollow tube of plastic and the adjustment adapters are secured to either end of the hollow tube handle-grip.

In an exemplary embodiment, a conventional crutch, having a straight handle extending across aligned crutch support apertures, is replaced with an angle adjustable crutch handle of the present invention. The conventional crutch handles extend perpendicular to the vertical crutch supports, or substantially horizontally, and a single fastener extends through the hollow handle-grip and a fastener secures it in place. Again, this orientation is not preferred for weight bearing as it puts the hand in a non-neutral physiologic position that strains the hand as well as the wrist. After removal of the conventional crutch handle, an exemplary angle adjustable crutch handle of the present invention can then be secured to the crutch at an offset angle. A first fastener may extend from the first adjustment adapter, through the first fastener slot, and can be inserted through an aperture in a first crutch support and secured to the first crutch support by a fastener retainer, such as a wing-nut for example. A second fastener may then be inserted through the fastener slot of the second adjustment adapter, while aligned with a second aperture in a second crutch support. The second fastener extends through the second adjustment adapter and through the second aperture in the second crutch support. The handle-grip can then be adjusted to a desired offset angle and a fastener retainer can be used to secure the second side, of the crutch-handle to the crutch support at an offset angle. The fasteners may comprise a threaded portion, or threads, for receiving a fastener retainer, such as a nut or preferably a wing-nut, as these are able to be tightened by hand.

Crutches may have varying widths between the vertical supports in the handle grip portion of the crutch. Therefore, a crutch adapter may be used to secure an exemplary angle adjustable crutch handle to the crutch. The crutch adapter may have a serrated contact surface that mates with a serrated outer surface of an adjustment adapter. In an exemplary embodiment, a crutch handle system comprises two separate crutch adapters, one for placement between the first support of the crutch and the first adjustment adapter of the crutch handle and one for placement between the second support of the crutch and the second adjustment adapter of the crutch handle. The mating surfaces of a crutch adapter may be serrated to mate with a serrated surface of an adjustment adapter to better retain the handle in a set angular orientation between the first and second vertical crutch supports. These mating serrated surfaces may prevent the handle grip from slipping from a desired orientation, or angle after a fastener is secured. The serrated surfaces may have a plurality of teeth that extend out from the surface. The height of the serrations, or teeth faces may be small, such as about 5 mm or less, or about 3 mm or less or even 2 mm or less. The serrated mating surfaces may enable load sharing between the crutch handle and crutch adapter. A crutch adapter may comprise a slot or aperture for receiving a fastener therethrough to secure the crutch adapter to the vertical support of the crutch. In addition, a crutch adapter may have side extensions that extend around a portion of a crutch support. These side extensions may prevent the crutch adapter and crutch handle coupled thereto from rotating during use.

An exemplary handle grip of a crutch handle of the present invention may comprise a resilient material that may be soft and compliable to provide a comfortable surface for a user to grip. In addition, an exemplary grip may have contoured surfaces, such as grooves and/or ridges along the bottom surface for finger placement.

The summary of the invention is provided as a general introduction to some of the embodiments of the invention, and is not intended to be limiting. Additional example embodiments including variations and alternative configurations of the invention are provided therein.

BRIEF DESCRIPTION OF SEVERAL VIEW OF THE DRAWINGS

The accompanying drawings are included to provide a further understanding of the invention and are incorporated in and constitute a part of this specification, illustrate embodiments of the invention, and together with the description serve to explain the principles of the invention.

Figure 16:
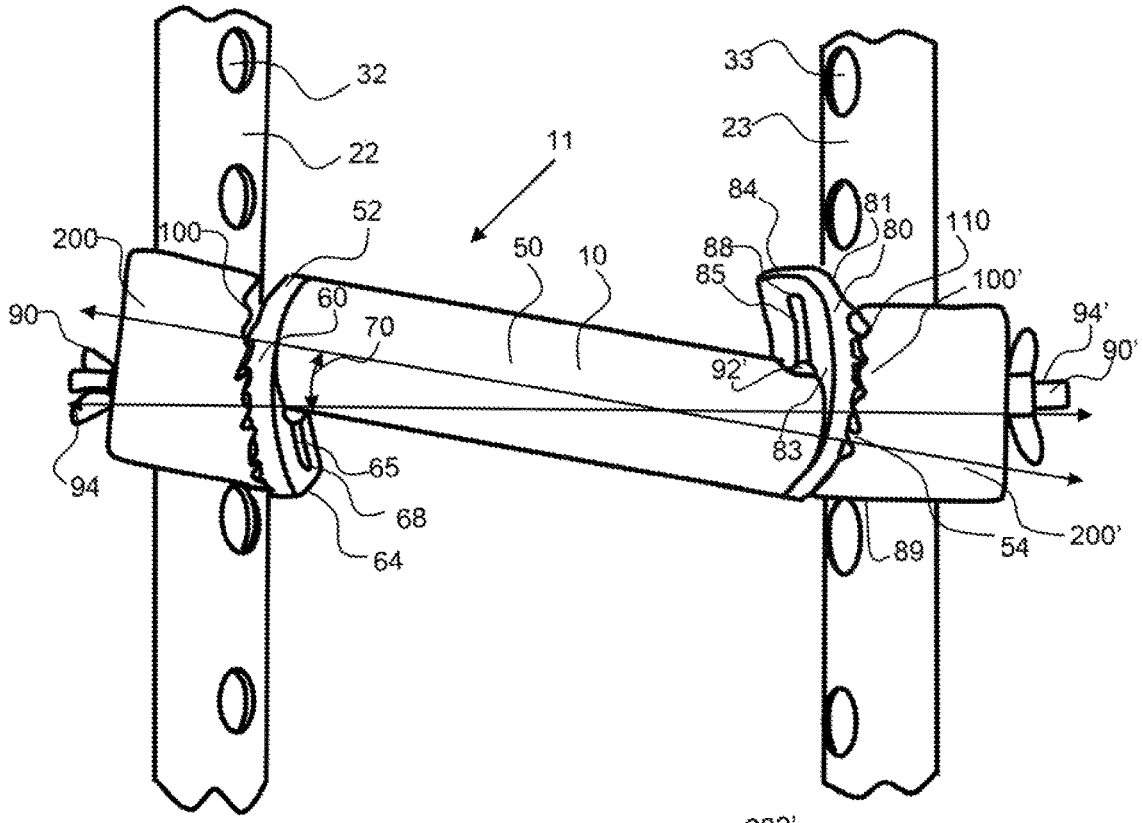

FIG. 16 shows a perspective and enlarged view of an exemplary angle adjustable crutch handle system comprising an exemplary crutch handle and adjustment adapters attached between the first and second crutch supports at an offset angle to provide a more comfortable and anatomically correct load bearing orientation of the handle-grip, and adapter brackets that extend around the crutch supports to engage with the outer surface of the adjustment adapter.

Figure 17:
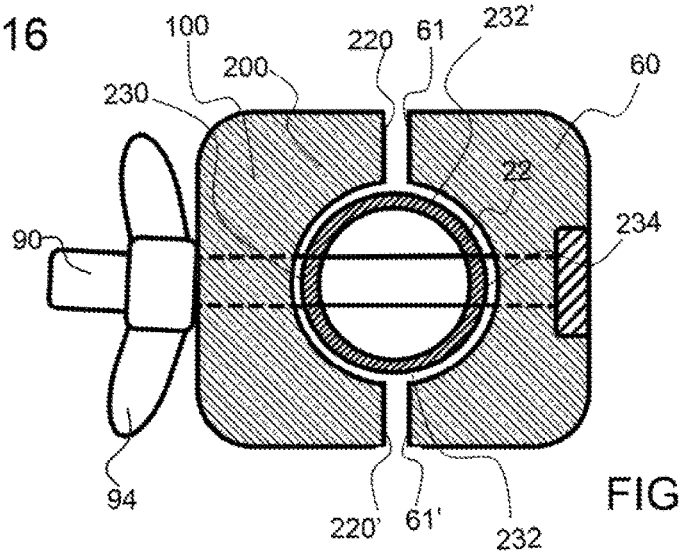

FIG. 17 shows a cross-sectional view of an adjustment adapter and adapter bracket configured around a crutch support.

Figure 18:
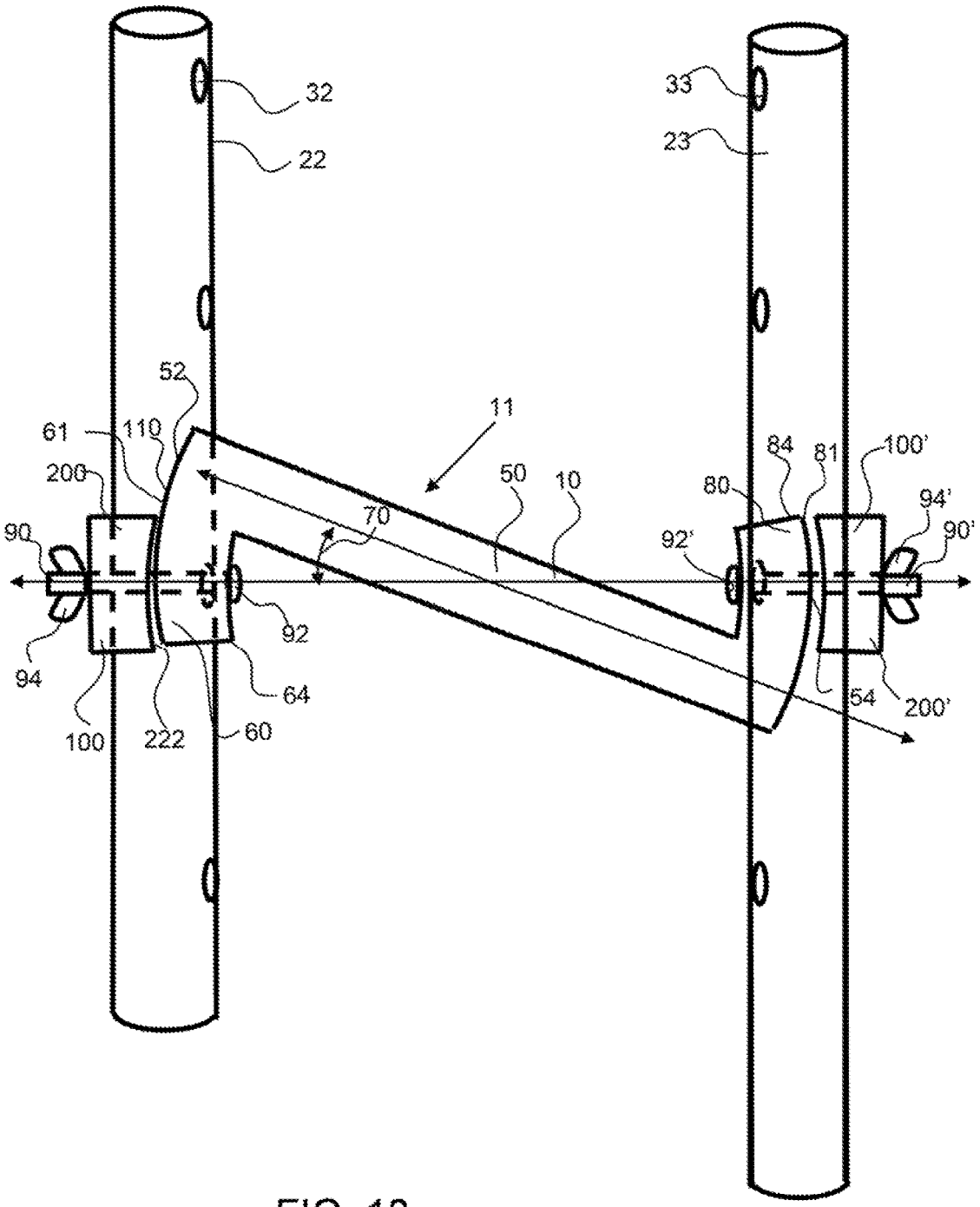

FIG. 18 shows a perspective and enlarged view of an exemplary angle adjustable crutch handle system comprising an exemplary crutch handle and adjustment adapters attached between the first and second crutch supports at an offset angle to provide a more comfortable and anatomically correct load bearing orientation of the handle-grip, and adapter brackets that extend around the crutch supports to engage with the outer surface of the adjustment adapter.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has" "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or an are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 1:
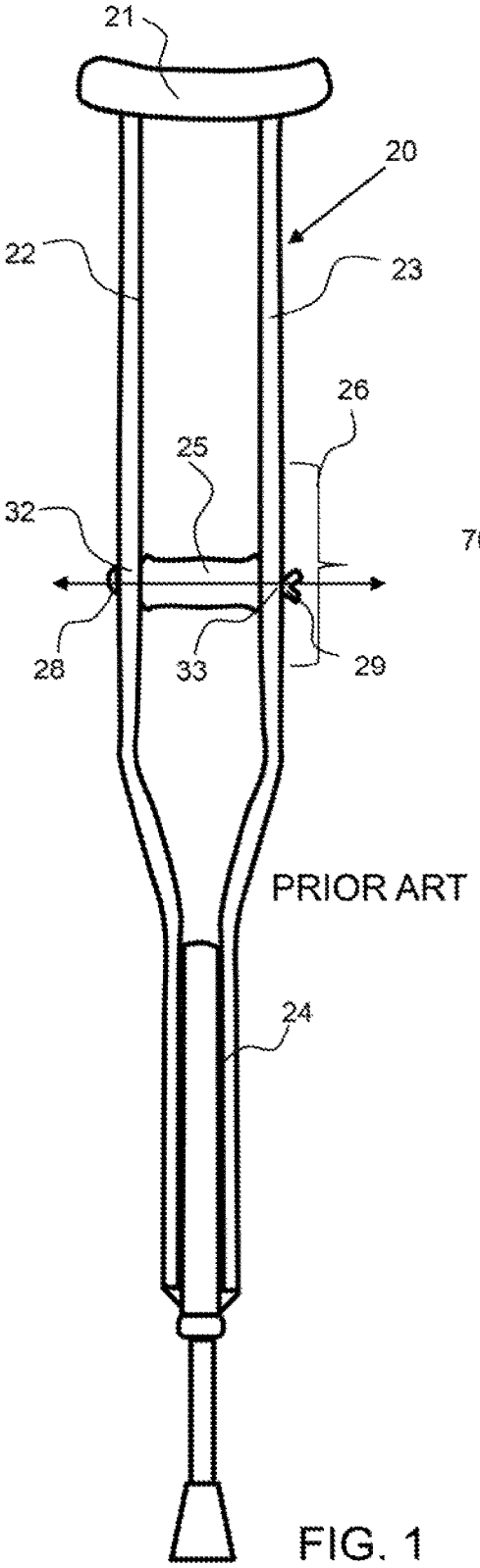
FIG. 1 shows a standard crutch having a length adjustment section and a grip length adjustment section.

As shown in FIG. 1, a standard crutch 20 has a length adjustment section 24 and a grip length adjustment section 26. The overall length of the crutch can be adjusted by the of the length adjustment section. The grip length, or length from the crutch pad 21 to the handle-grip 25, may be adjusted by moving the handle-grip by aligning it with a pair of support apertures 32, 33 in the first support 22 and second support 23, respectively, and securing a fastener 28 therethrough. The first and second supports extend substantially vertically. A fastener retainer 29, such as a wing-nut, secures the fastener in place. The handle-grip is in a horizontal orientation, or extends substantially perpendicular to the first and second supports.

Figure 2:
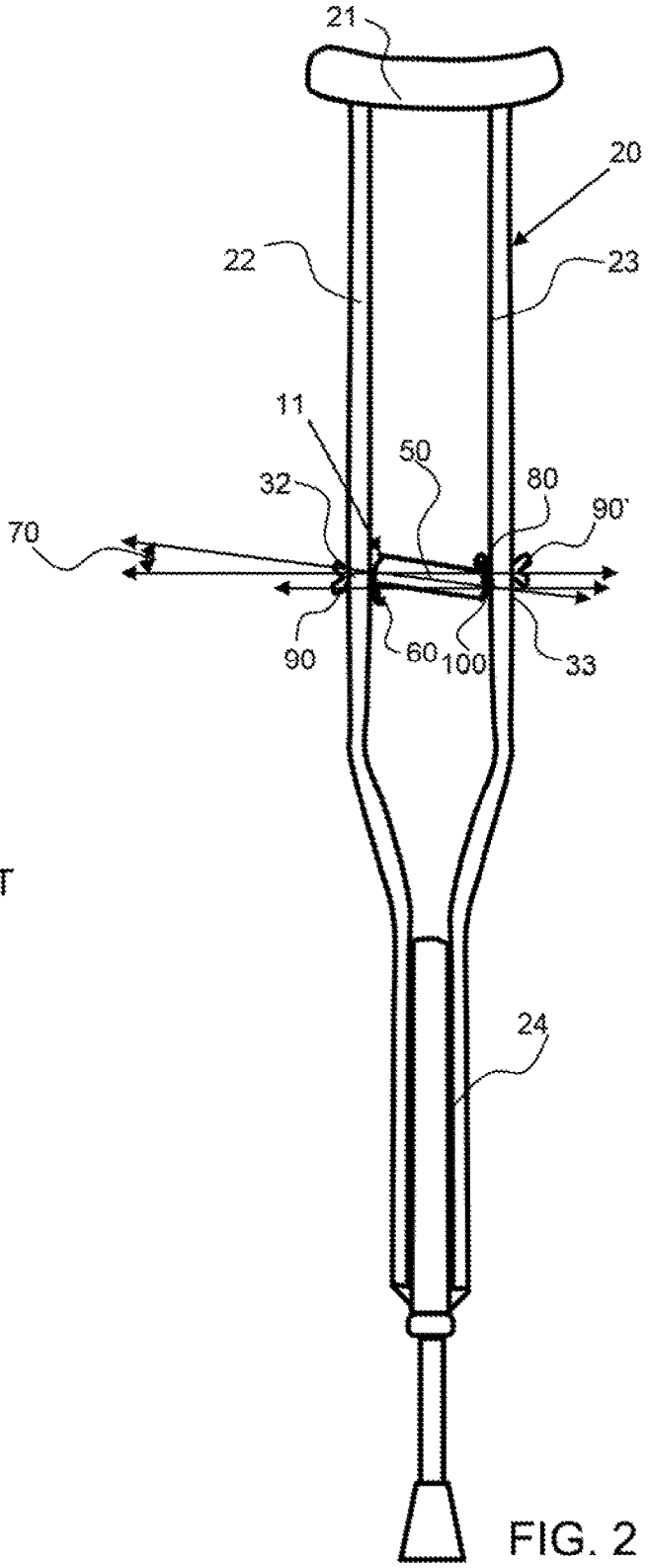
FIG. 2 shows a standard crutch having an exemplary angle adjustable crutch handle system comprising an exemplary crutch handle, as described herein, attached between the first and second supports at an offset angle to provide a more comfortable and, anatomically correct load bearing orientation of the handle-grip.

As shown in FIG. 2, a standard crutch 20 is adapted with an exemplary crutch handle system 11 to position an exemplary angle adjustable crutch handle 10 between the first support 22 and second support 23 at an offset angle 70 to provide a more comfortable and anatomically correct load bearing orientation of the handle-grip 50. The angle adjustable crutch handle 10 has a handle-grip 50 configured between a first adjustment adapter 60 and a second adjustment adapter 80. A crutch adapter 100 is configured between the first and second adjustment adapters to retain the crutch handle in a fixed orientation. The first and second adjustment adapters have a slot for receiving separate fasteners 90, 90'. The angle adjustable crutch handle 10 is configured at an offset angle and the separate fasteners extend through the adjustment adapters and through support apertures 32, 33 in the respective crutch supports to secure the angle adjustable crutch handle 10 in an offset angle. The support apertures 32, 33 are aligned horizontally, however the slots in the adjustment adapters allow the handle-grip to be retained at an offset angle.

Figure 3:
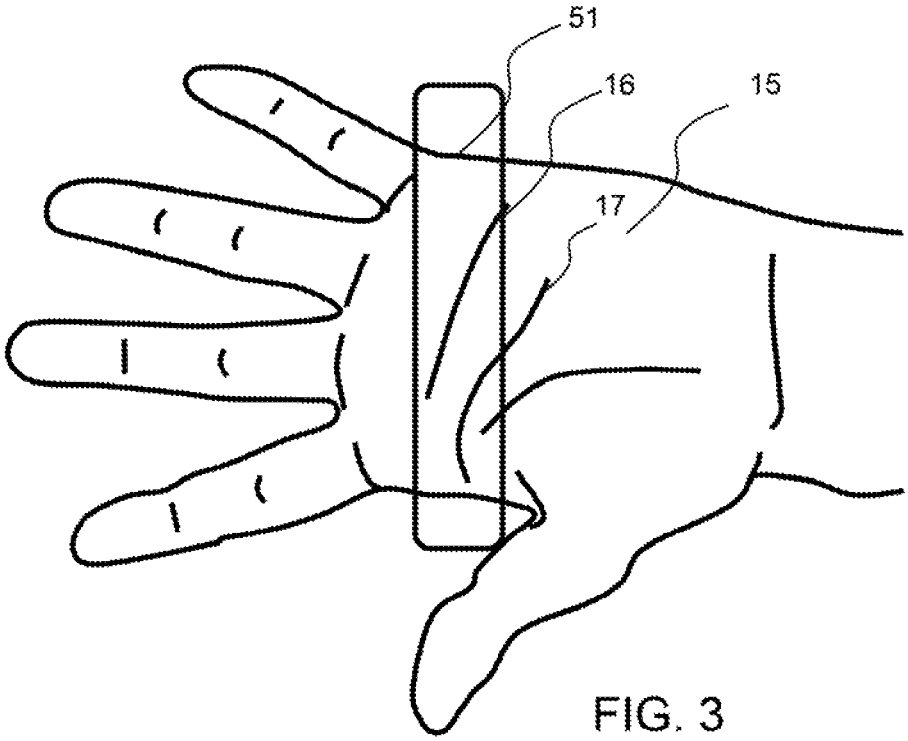
FIG. 3 shows a view of a hand with a handle extending straight across the palm, such as with conventional crutches with horizontal handle-grips.

As shown in FIG. 3, a conventional handle-grip 51 is extending straight across the palm of the hand 15. This is the position of a conventional crutch handle-grip, wherein the handle-grips are parallel with the floor, or put another way, extend perpendicularly to the first and second vertical supports of the crutch. The handle-grip is not aligned with the distal palmer crease 16 or proximal palmer crease 17.

Figure 4:
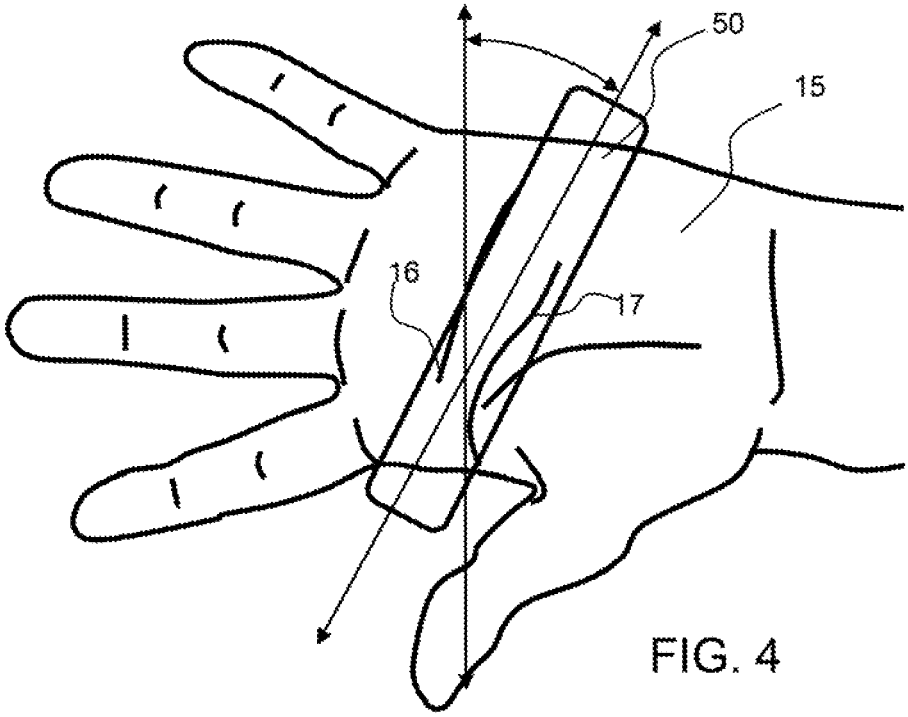
FIG. 4 shows a view of a hand with a handle extending in a neutral position that provides an ergonomic weight bearing position.

As shown in FIG. 4, a handle-grip 50 is extending in a neutral position across the palm. This position of the handle-grip relative to the hand provides an ergonomic weight bearing position. The handle-grip is aligned with the distal palmer crease 16 and proximal palmer crease 17.

Figure 5:
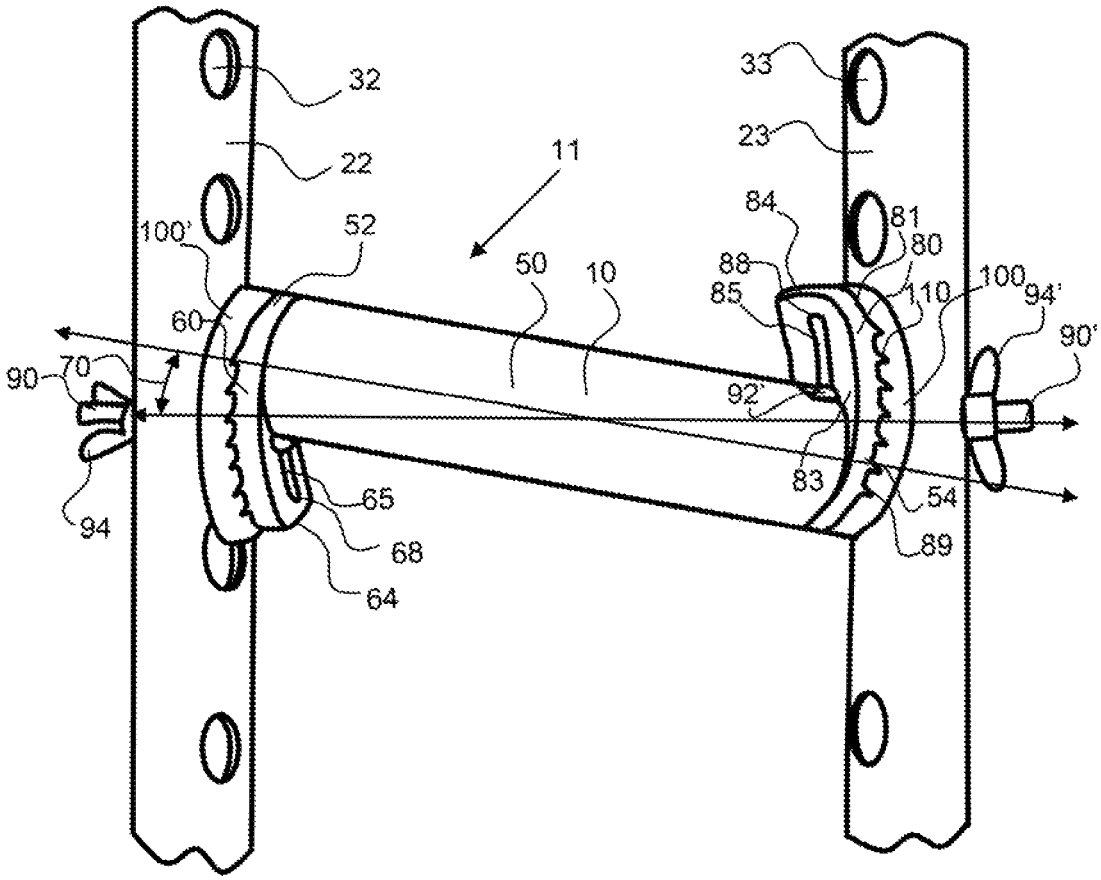
FIG. 5 shows a perspective and enlarged view of an exemplary angle adjustable crutch handle system comprising an exemplary crutch handle and crutch adapters attached between the first and second supports of the crutch at an offset angle to provide a more comfortable and anatomically correct load bearing orientation of the handle-grip.

As shown in FIG. 5, an, exemplary angle adjustable crutch system 11 comprises a crutch handle 10 that is attached between the first crutch support 22 and a second crutch support 23 at an offset angle 70 to provide a more comfortable and anatomically correct load bearing orientation of the handle-grip 50. The crutch handle is configured between a first crutch adapter 100 and a second crutch adapter 100'. The crutch adapters have a serrated surface 110 for mating with a serrated surface 89 of the adjustment adapter. In addition, the mating serrated surface of the crutch adapter is curved to mate with the adjustment adapter. The serrated surface of the crutch adapter is concave to mate with the convex outer surface 81 of the adjustment adapter 80, which is also a serrated surface 89. These mating serrated surfaces prevent the angle adjustable crutch handle from slipping during use. A first fastener 90 secures the first end 52 of the angle adjustable crutch handle 10 to the first support 22. The first fastener extends through the fastener slot 65 in the first adjustment adapter 60 and, through the crutch adapter 100', and a fastener retainer 94 secures the fastener and the first end 52 in place. The head of the first adapter is within an opening of the handle-grip 50. A second fastener 90' secures the second end 54 of the angle adjustable crutch handle 10 to the second support 23. The second fastener 90' extends through the fastener slot 85 in the second adjustment adapter 80 and through the crutch adapter 100, and a fastener retainer 94' secures the fastener and the second end 54 in place. The fastener head 92' of the second fastener 90' is shown retained by the second adjustment adapter 80. The first fastener slot extends from an extended slot end 68 to a connected slot end, not shown, that is over the end of the handle-grip 50. The second fastener slot 80 extends from an extended slot end 88 to a connected slot end, not shown. The first adjustment adapter 60 has an extended end 64 and the second adjustment adapter 80 has an extended end 84. These extensions allow for an angular adjustment of the handle-grip between the first and second supports. Support apertures 32, 33 in the first and second supports 22, 23 respectively are shown. Note that the angle adjustable crutch handle 10 is secured at an offset angle with fasteners configured in horizontally aligned apertures.

Figure 6:
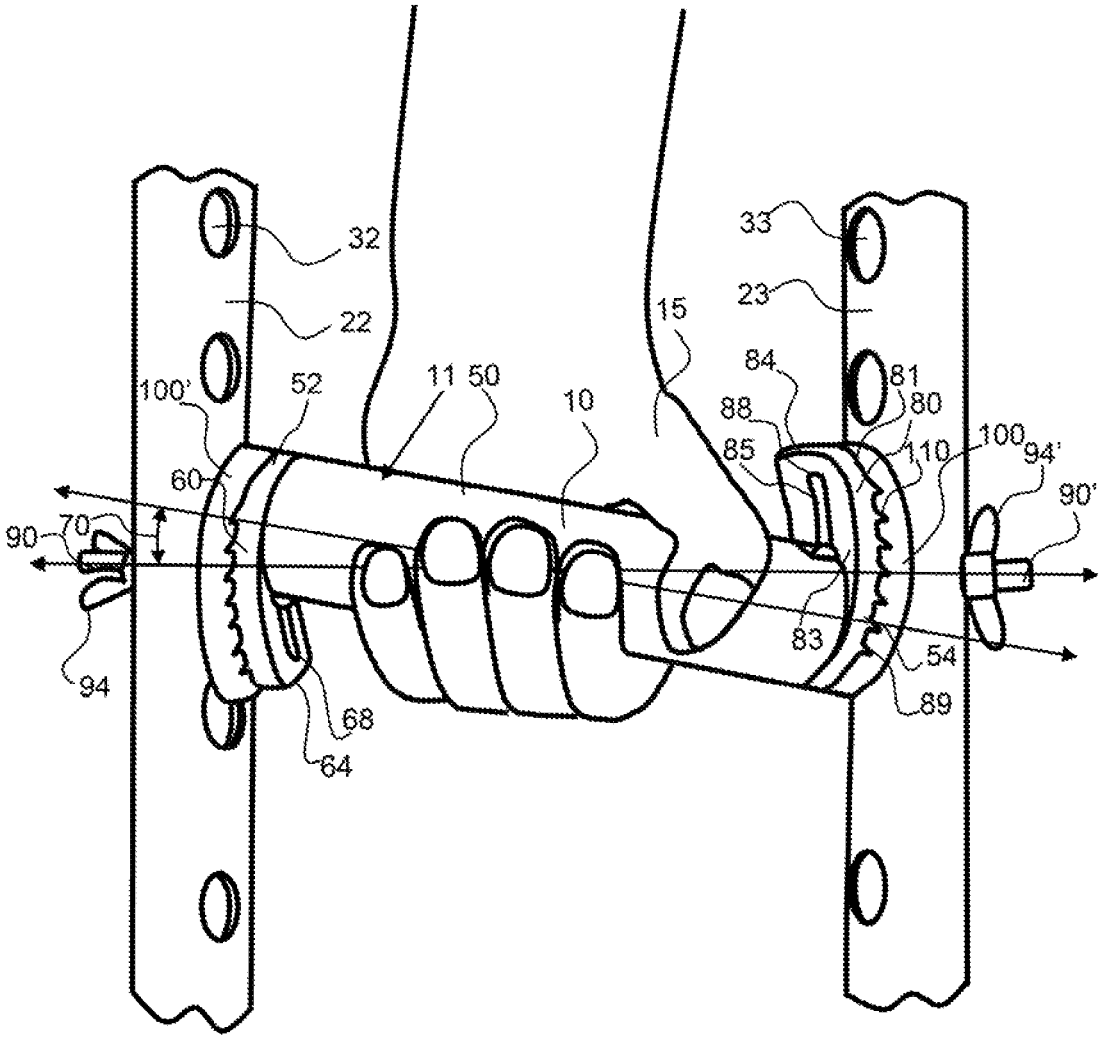
FIG. 6 shows a perspective and enlarged view of the exemplary angle adjustable crutch handle system having an exemplary crutch handle attached between the first and second supports as shown in FIG. 5, with a person gripping the handle-grip in an angle adjustable position.

As shown in FIG. 6, an exemplary angle adjustable crutch handle 10 is attached between the first and second supports 22, 23, as shown in FIG. 5, at an offset angle 70. A person is gripping the handle-grip with their hand 15 in an angle adjustable position. A user may adjust the offset angle 70 to optimize vertical alignment of the midline osseous structures of the hand, wrist and forearm to effectuate load bearing in a linear fashion thereby minimizing articular shear forces and maximizing load transfer with minimal energy expenditure of the adjoining stabilizing musculature. This linear loading also maximizes the articular surface contact area during load transfer from the distal to the proximal joints thereby lowering the peak compressive forces, that is PSI, sustained by all joints and thereby minimizes the risk of chondral damage to a structure that was not designed for load bearing of this magnitude.

Figure 7:
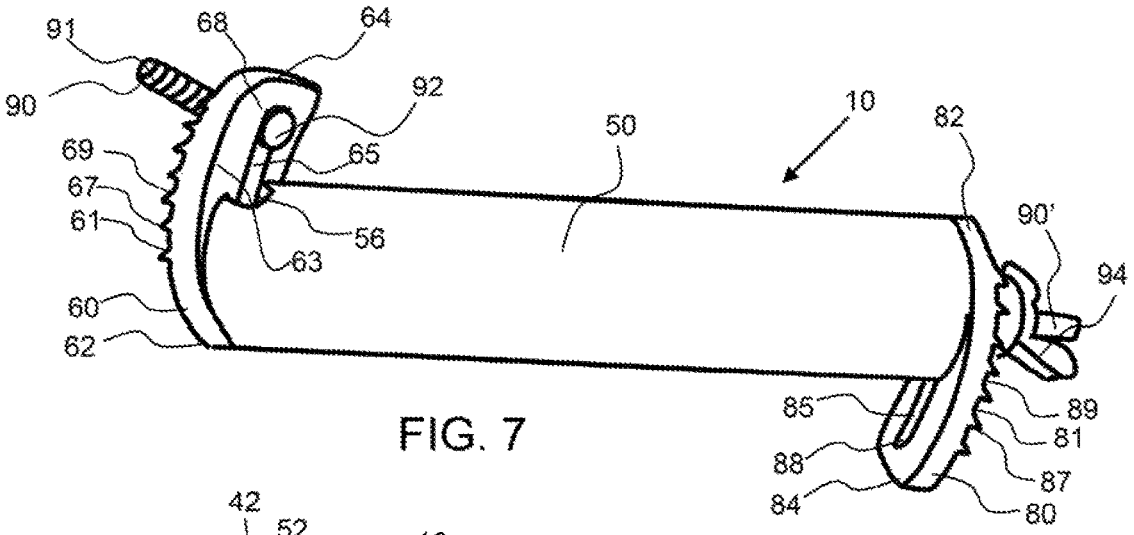
FIG. 7 shows a side view of an exemplary angle adjustable crutch handle having a handle-grip between a first adjustment adapter and a second adjustment adapter.
Figure 8:
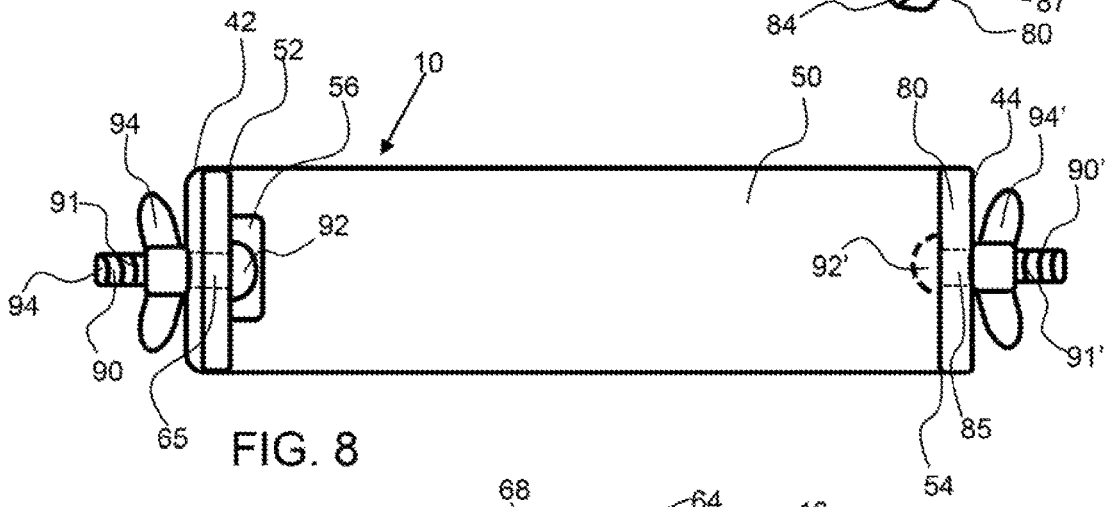
FIG. 8 shows a top view of an exemplary angle adjustable crutch handle having a handle-grip between a first adjustment adapter and a second adjustment adapter and a fastener opening in the handle-grip to allow the fastener head to move in alignment with the handle-grip portion.
Figure 9:
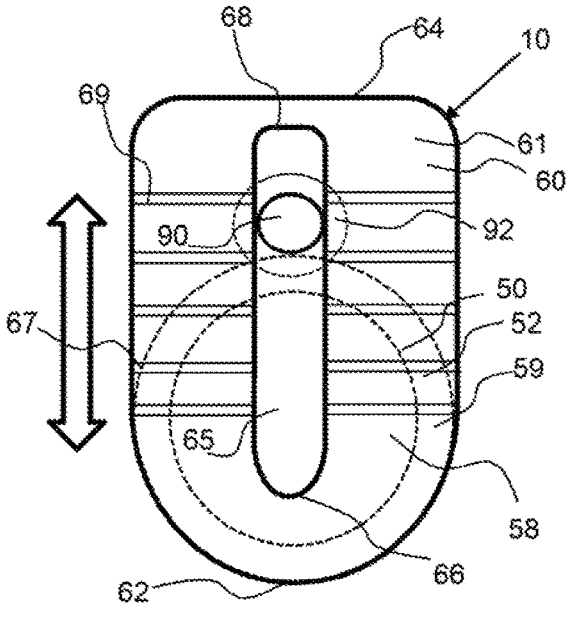
FIG. 9 shows an end view of an exemplary angle adjustable crutch handle having a first adjustment adapter configured with a fastener slot for receiving a fastener.
Figure 10:
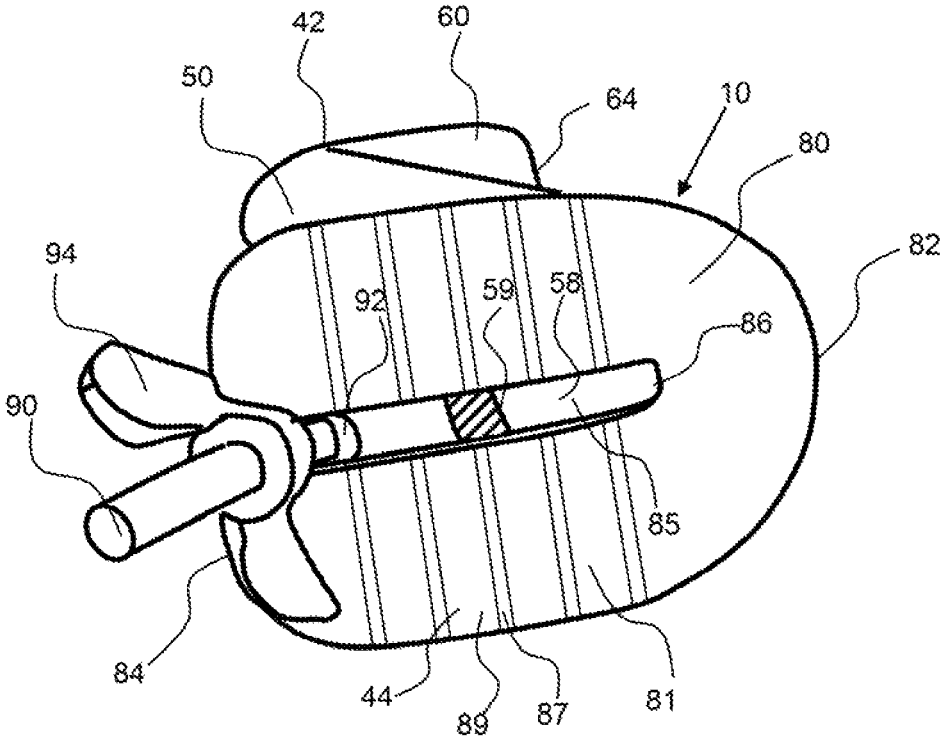
FIG. 10 shows a perspective end view of an exemplary angle adjustable crutch handle having a first adjustment adapter configured with a fastener slot for receiving a fastener.

Referring now to FIGS. 7 to 10, an exemplary angle adjustable crutch handle 10 comprises a handle-grip 50 extending between a first adjustment adapter 60 and a second adjustment adapter 80. The first and second adjustment adapters have a radiused outer surface 61, 81, respectively, to allow a tight and secure fit between the a first and second crutch adapter even when positioned at an offset angle to, horizontal. Also, both the first and second adjustment adapters have a serrated outer surface 69, 89, comprising a plurality of serrations 67, 87 respectively, such as teeth that extend out to secure the crutch handle in a desired orientation. The curved or radiused outer surfaces 61, 81, of the first and second adjustment adapters, respectively, may be a 5 cm radius or more, about 8 cm radius or more, about 10 cm radius or more, and any range between and including the radius values provided. The first and second adjustment adapters have an extended end 64, 84, respectively, that is extend from the handle-grip 50 and, as shown, extend in opposing directions. Again, these extensions extending in opposing directions allows a tight and secure fit between the first and second crutch supports even when positioned at an offset angle to horizontal. The first adjustment adapter 60 has a fastener slot 65 that extends from an extended slot end 68 to a connected slot end 66, as shown in FIG. 9. The connected slot end 66 is closer to the handle-grip than the extended slot end and is aligned with the handle-grip. Likewise the second adjustment adapter 80 has a fastener slot 85 that extends from an extended slot end to a connected slot end 86, as shown in FIG. 10. The handle-grip has a fastener opening 56 that allows a fastener 90 that has been inserted through the fastener slot, to slide along the slot to be aligned with the handle-grip. The fastener slot may have a recessed portion along the slot to produce an fastener opening. As shown in FIG. 7, the fastener head 92 is retained by an inner surface 63 of the first adjustment adapter 60. The fastener opening 56 in the handle-grip allows the fastener head to slide down to be aligned with or be configured within fastener opening 56 within the handle-grip. The top view of FIG. 8, shows the fastener head 92 aligned with the fastener opening 56. This configuration provides a range of motion of the fastener along the fastener slot as indicated by the bold double ended arrow in FIG. 9. As best shown in FIG. 9, an exemplary handle-grip 50 has an opening 58 and a grip wall 59. In this embodiment, the handle grip, or at least the end is tubular in shape. The handle-grip has a length from the first end 52 to second end 54. The exemplary angle adjustable crutch handle 10 has a length from a first end 42 to a second end 44. The first and second adjustment adapters have a length from an extended end 64, 84 to a connected end 62, 82, respectively. The fasteners 90 may comprises threads 91 for receiving the fastener retainer 91, a nut or wing-nut, having corresponding threads with the fastener.

Figure 11:
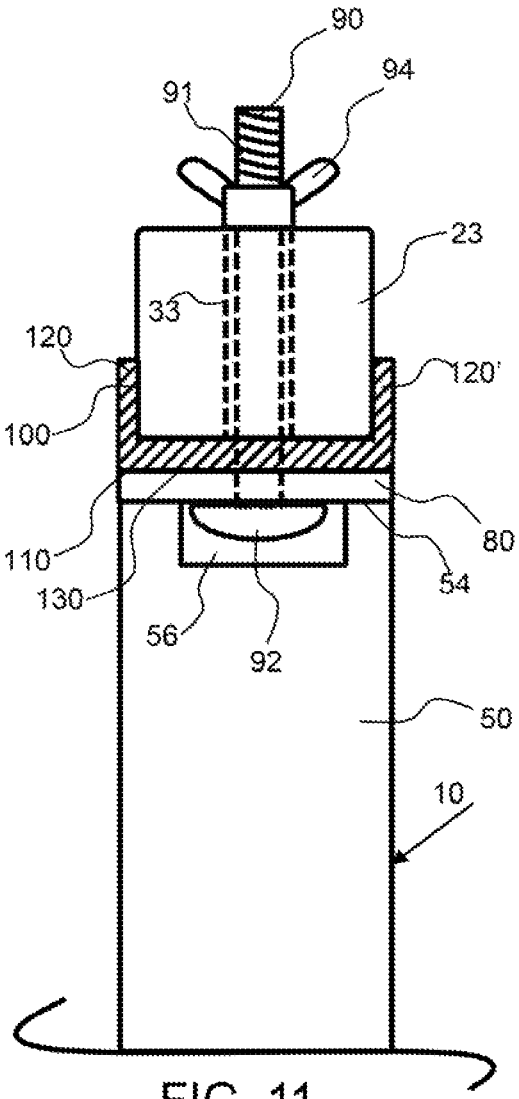
FIG. 11 shows a top view of one end of an exemplary crutch handle system attached to a rectangular shaped crutch support.

As shown in FIG. 11, an exemplary crutch handle system 11 is attached to a rectangular shaped crutch support 23. The crutch support has a support aperture 33 for receiving the fastener 90. The fastener head 92 is retained on the inside surface of the adjustment adapter 90 and extends through the crutch adapter 100. The crutch, adapter has side extensions 120, 120' that extend around the sides of the crutch support, to prevent rotation of the handle during use. These side extensions may extend a portion over a side or around the crutch support. As shown in FIG. 11, the crutch support is rectangular in cross sectional shape and the side extensions extend over the planar side surfaces of the crutch support. The surface of the crutch adapter coupled to the crutch support, or outer crutch adapter surface, forms a channel for receiving the crutch support. The crutch adapter has a serrated surface 110 on the mating surface 130 that mates with the adjustment adapter 80 to retain it in a fixed location. The mating surface of the adjustment adapter 80 and crutch adapter 100 are serrated to prevent the crutch handle 10 from slipping from a desired orientation during use.

Figure 12:
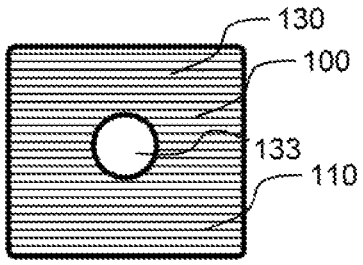
FIG. 12 shows the mating surface of the crutch adapter shown in FIG. 11 having, a serrated surface.

As shown in FIG. 12, the mating surface 130 of the crutch adapter 100 shown in FIG. 11 has a serrated surface 110. A crutch adapter aperture 133 is configured to receive a fastener therethrough.

Figure 13:
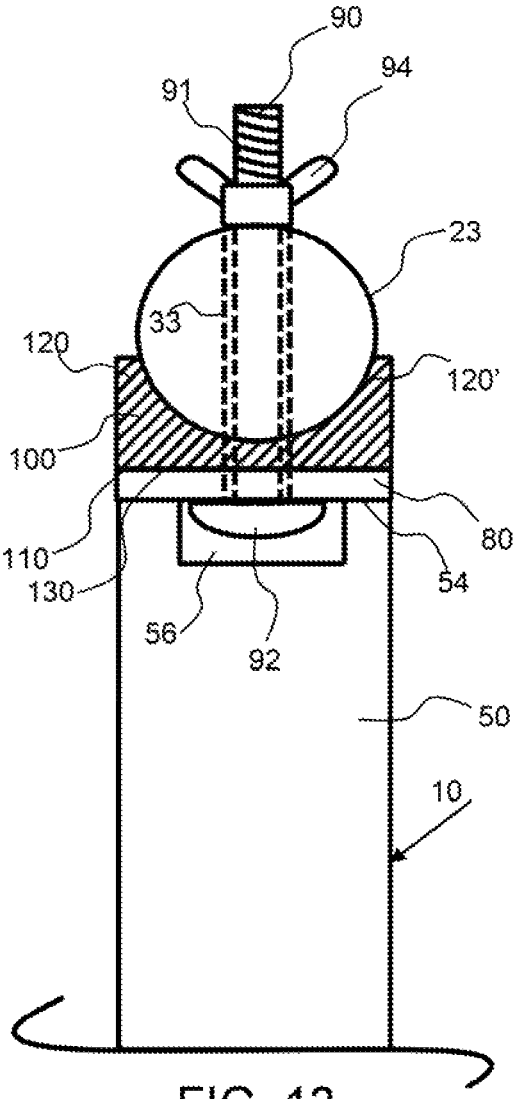
FIG. 13 shows a top view of one end of an exemplary crutch handle system attached to a circular shaped crutch support.

As shown in FIG. 13, an exemplary crutch handle system 11 is coupled to a crutch support 23 having a circular cross-sectional shape. The crutch support has a support aperture 33 for receiving the fastener 90. The fastener head 92 is retained on the inside surface of the adjustment adapter 90 and extends through the crutch adapter 100. The crutch adapter has side extensions 120, 120' that extend around the sides of the crutch support, to prevent rotation of the handle during use. These side extensions are curved or have a radius to mate with the circular shape of the crutch support. The surface of the crutch adapter coupled to the crutch support, or outer crutch adapter surface, forms a channel for receiving the crutch support. As shown in FIG. 11, the crutch support is rectangular in cross sectional shape and the side extensions extend over the planar side surfaces of the crutch support. The crutch adapter has a serrated surface 110 on the mating surface 130 that mates with the adjustment adapter 80 to retain it in a fixed location. The mating surface of the adjustment adapter 80 and crutch adapter 100 are serrated to prevent the crutch handle 10 from slipping from a desired orientation during use.

Figure 14:
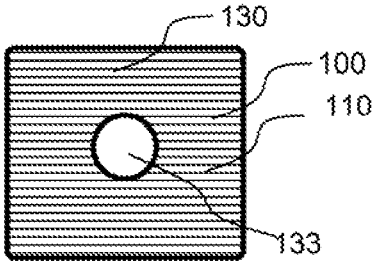
FIG. 14 shows the mating surface of the crutch adapter shown in FIG. 13 having a serrated surface.

As shown in FIG. 14, the mating surface 130 of the crutch adapter 100 shown in FIG. 13 has a serrated surface 110. A crutch adapter aperture 133 is configured to receive a fastener therethrough.

Figure 15:
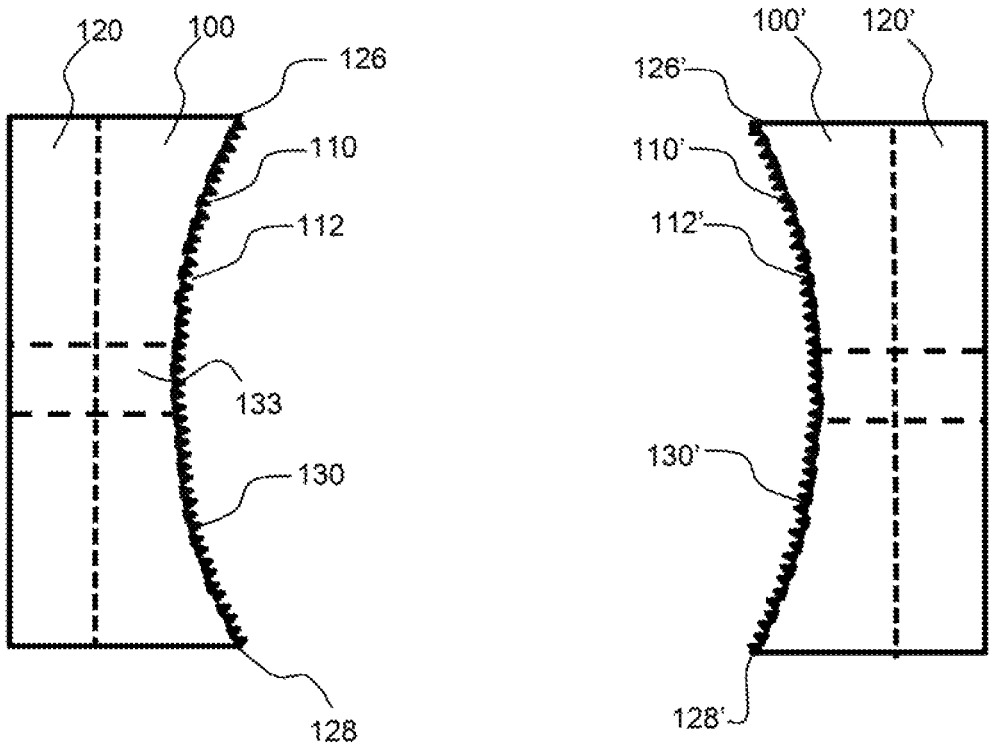
FIG. 15 shows a side view of the left and right crutch adapter, having a curved and serrated mating surface for mating with the adjustment adapter of the crutch handle.

As shown in FIG. 15, left and right crutch adapters 100, 100', have curved and serrated mating surfaces 130, 130 for mating with the adjustment adapter of the crutch handle. The serrated surfaces 110 have serrations 112 for mating with serrations on the adjustment adapter. A crutch adapter aperture 133 is configured to receive a fastener therethrough.

Referring now to FIGS. 16 to 18, an exemplary angle adjustable crutch system 11 comprises a crutch handle 10 that attached between the first crutch support 22 and a second crutch support 23 at an offset angle 70 to provide a more comfortable and anatomically correct load bearing orientation of the handle-grip 50. The crutch handle is configured between a first crutch support 22 and a second crutch support 23. The adjustment adapters have a serrated surface 110 for mating with a serrated surface 222 of the adapter brackets. The adapter brackets extend around the outer perimeter of the crutch supports to engage with the outer surface of the adjustment adapters. In addition, the mating serrated surface of the adjustment adapter is curved to mate with the adapter bracket. The serrated surface of the adjustment adapter is concave to mate with the convex mating surface 220 of the adapter bracket 200, which is also a serrated surface 222. These mating serrated surfaces prevent the angle adjustable crutch handle from slipping, during use and from spinning or rotating.

The adapter bracket 200 extends around the outer perimeter of the crutch support to provide a mating surface on either side, or opposing sides of the crutch support, as best shown in FIG. 17. The adapter bracket extends from the outside of the crutch support 230 and along opposing sides 232, 232' where it mates with the adjustment adapter. The adjustment adapter extends from the inside surface of the crutch support 234, partially around the crutch support to provide two separate outer surfaces 61, 61' for mating with the two separate mating surfaces 220, 220' of the adapter bracket 200. It is to be understood that the adapter, bracket may extend from the outside of the crutch support 230 to the inside of the crutch support 234, or the adjustment adapter may extend from the inside of the crutch support 234 to the outside of the crutch support 230, wherein it interfaces with the adapter bracket. The engagement of these two surfaces and the extension around the crutch support of the adjustment adapter and/or the adapter bracket prevents the handle-grip from spinning or rotating during use. A first fastener 90 secures the first end 52 of the angle adjustable crutch handle 10 to the first support 22 and to the adapter bracket 200. The first fastener extends through the fastener slot 65 in the first adjustment adapter 60, through the crutch support and the adapter bracket 200. A fastener retainer 94 secures the fastener and the first end 52 in place against the adapter bracket. The head of the first adapter is within an opening of the handle-grip 50. The fastener retainer 94, such as a wing nut, is secured against the adapter bracket 200 which presses the outer surface 61 of the adjustment adapter 60 and the mating surface 220 of the adapter bracket 200 together. A second fastener 90' secures the second end 54 of the angle adjustable crutch handle 10 to the second support 23. The second fastener 90' extends through the fastener slot 85 in the second adjustment adapter 80, through the crutch support, and through the adapter bracket 200'. A fastener retainer 94' secures the fastener 90' and the second end 54 in place to the adapter bracket 200'. The fastener head 92' of the second fastener 90' is shown retained by the second adjustment adapter 80. The first fastener slot extends from an extended slot end 68 to a connected slot end, not shown, that is over the end of the handle-grip 50. The second fastener slot 80 extends from an extended slot end 88 to a connected slot end, not shown. The first adjustment adapter 60 has an extended end 64 and the second adjustment adapter 80 has an extended end 84. These extensions allow for an angular adjustment of the handle-grip between the first and second supports. Support apertures 32, 33 in the first and second supports 22, 23 respectively are shown. Note that the angle adjustable crutch handle 10 is secured at an offset angle with fasteners configured in horizontally aligned apertures.

As shown in FIG. 18, the fasteners 90, 90' extend through the adjustment adapters 60, 80, respectively, and then through the support apertures of the first and second crutch supports 22, 23, and finally through the adapter brackets 200, 200', respectively. A fastener head 92, 92' secures the fastener to the adjustment adapter and a fastener retainer 94, 94' secures the fastener to the adapter bracket. The wing nut may be tightened to bring the outer surface 61 of the adjustment adapter 60, which is a serrated surface 110, in contact with the mating surface 220 of the adapter bracket 200, which may also be a serrated surface 222. Again, the mating of these surfaces with the adapter bracket and adjustment adapter extending around the crutch support prevents any rotation of the handle-grip 50. The serrated surfaces improve the interface and prevent sliding of the surfaces vertically and secures the offset angle in place.

It will be apparent to those skilled in the art that various modification combinations and variations can be made in the present invention without departing from the spirit or scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An angle adjustable crutch handle comprising:

a) a handle-grip comprising:
  i) a first end;
  ii) a second end; and
  iii) a first fastener opening on the first end;

b) a first adjustment adapter configured on the first end of the handle-grip;

second adjustment adapter configured on the second end of the handle-grip;

wherein each of the first and second adjustment adapters comprise:

a fastener slot that extends from an extended slot end to a connected slot end;

a curved outer surface;

wherein the first fastener opening is configured between the handle-grip and the first adjustment adapter to receive a first fastener head of a first fastener that extends through the first fastener slot; and wherein a second fastener extends through the second fastener slot;

wherein the first and second fasteners retain the angle adjustable crutch handle to a crutch;

d) a first crutch adapter that extends around a first crutch support and engages with the curved outer surface of the first adjustment adapter;

e) a second crutch adapter that extends around a second crutch support and engages with the curved outer surface of the second adjustment adapter wherein the first fastener extends through the first crutch adapter; and wherein the second fastener extends through the second crutch adapter.

2. The angle adjustable crutch handle of claim 1, further comprising a second fastener opening on the second end of the handle-grip; and wherein the second fastener opening is configured between the handle-grip and the second adjustment adapter to receive the second fastener head of a second fastener that extends through the second fastener slot.

3. The angle adjustable crutch handle of claim 1, wherein the curved outer surfaces of the first and second adjustment adapters extend along a radius.

4. The angle adjustable crutch handle of claim 3, wherein the radius is 5 cm or more.

5. The angle adjustable crutch handle of claim 3, wherein the curved outer surfaces of the first and second adjustment adapters comprises a serrated surface.

6. The angle adjustable crutch handle of claim 1, wherein the first crutch adapter is a first adapter bracket and wherein the second crutch adapter is a second adapter bracket, wherein each of the first and second adapter brackets have a mating surface that engages with the curved outer surface of the adjustment adapter.

7. The angle adjustable crutch handle of claim 6, wherein the first and second adapter brackets each have two separate mating surfaces.

8. The angle adjustable crutch handle of claim 7, wherein the mating surfaces of the first and second adapter brackets are concave to mate with a convex outer surface of the first and second adjustment adapters.

9. The angle adjustable crutch handle of claim 8, wherein the mating surfaces of the first and second adapter brackets are serrated to mate with a serrated outer surface of the first and second adjustment adapters, respectively.

10. The angle adjustable crutch handle of claim 6, wherein the mating surfaces of the first and second adapter brackets are concave to mate with a convex outer surface of the first and second adjustment adapters, respectively.

11. The angle adjustable crutch handle of claim 6, wherein the mating surfaces of the first and second adapter brackets are serrated to mate with a serrated outer surface of the first and second adjustment adapters, respectively.

12. The angle adjustable crutch handle of claim 11, wherein the mating surfaces of the first and second adapter brackets are concave to mate with a convex outer surface of the first and second adjustment adapters, respectively.

13. The angle adjustable crutch handle of claim 12, wherein the first and second adapter brackets each have two separate mating surfaces.

14. The angle adjustable crutch handle of claim 13, wherein the first and second adapter brackets each extend partially around the crutch support.

* * * * *